US011421446B2

(12) United States Patent
Tan

(10) Patent No.: US 11,421,446 B2
(45) Date of Patent: Aug. 23, 2022

(54) INTELLIGENT UNLOCKING DEVICE

(71) Applicant: Shenzhen SeamoonCloud Technology Co., Ltd., Shenzhen (CN)

(72) Inventor: Xiaozhong Tan, Shenzhen (CN)

( * ) Notice: Subject to any disclaimer, the term of this patent is extended or adjusted under 35 U.S.C. 154(b) by 302 days.

(21) Appl. No.: 16/585,647

(22) Filed: Sep. 27, 2019

(65) Prior Publication Data

US 2020/0115926 A1 Apr. 16, 2020

(30) Foreign Application Priority Data

Oct. 12, 2018 (CN) ..... 201821665665.4

(51) Int. Cl.

| | |
|---|---|
| ***E05B 47/06*** | (2006.01) |
| ***E05B 17/00*** | (2006.01) |
| *E05B 47/00* | (2006.01) |

(52) U.S. Cl.

CPC ..... *E05B 47/0611* (2013.01); *E05B 17/0045* (2013.01); *E05B 2047/0091* (2013.01)

(58) Field of Classification Search

CPC ..... E05B 47/0611; E05B 17/0045; E05B 2047/0091; E05B 47/0001; E05B 47/0012; E05B 2047/0017; E05B 2047/0036; E05B 17/22; E05B 2047/0014; E05B 2047/0015; E05B 2047/0018; E05B 2047/002; E05B 2047/0094; E05B 47/0657; E05B 47/0665; E05B 47/0684; E05B 2047/0095; Y10S 292/25; G07C 9/00; G07C 9/0031; G07C 9/00134; G07C 9/00857

See application file for complete search history.

(56) References Cited

U.S. PATENT DOCUMENTS 5,694,798 A * 12/1997 Nunez ..... E05B 47/0661 70/224
2015/0102610 A1* 4/2015 Johnson ..... E05B 47/0012 292/144

FOREIGN PATENT DOCUMENTS

| | | | | |
|---|---|---|---|---|
| CN | 204759543 U | * | 11/2015 | ..... E05B 49/00 |
| CN | 106121379 A | * | 11/2016 | |
| CN | 106761002 A | * | 5/2017 | |
| CN | 107119999 A | * | 9/2017 | |
| EP | 1707712 A1 | * | 10/2006 | ..... E05B 47/068 |

* cited by examiner

*Primary Examiner* — Kristina R Fulton
*Assistant Examiner* — Tal Saif
(74) *Attorney, Agent, or Firm* — Novoclaims Patent Services LLC; Mei Lin Wong

(57) ABSTRACT

An intelligent unlocking device comprises a rear shell, a front shell, a motor assembly, a hollow rotating shaft, an adapting piece connected with a lock cylinder and the hollow rotating shaft, a manual rotating shaft, an inner bearing and a bearing support which are disposed around the manual rotating shaft, and an outer bearing. The bearing support and the outer bearing are disposed around an end of the manual rotating shaft. The intelligent unlocking device is silent and free of noises in use, and convenient to assemble and disassemble, intelligent unlocking can be achieved without replacement of a whole door lock, and costs are reduced for users.

13 Claims, 7 Drawing Sheets

INTELLIGENT UNLOCKING DEVICE

BACKGROUND OF THE INVENTION

1. Technical Field

The invention relates to the field of intelligent door locks, in particular to an unlocking device applied to the intelligent door locks.

2. Description of Related Art

At present, there are traditional locks capable of being unlocked with keys and intelligent door locks capable of being unlocked through fingerprints or wireless control, but these two types of locks cannot be used together, which means that if users want to control opening and closing of doors originally equipped with traditional locks by intelligent unlocking, the traditional locks have to be replaced with intelligent locks, and waste is caused. In order to reduce costs for the users, an intelligent unlocking device has been developed by means of transformations of the traditional locks, particularly by means of changes to the indoor side of the traditional locks. However, due to the fact that a front shell and a rear shell of existing unlocking devices used in cooperation with traditional door locks are in contact, intolerable noises may be generated during unlocking due to friction between the front shell and the rear shell.

BRIEF SUMMARY OF THE INVENTION

The objective of the invention is to overcome the defects of the prior art by providing an intelligent unlocking device which can facilitate the transformation of traditional door locks and can avoid noises when doors are opened.

The technical solution adopted by the invention to fulfill the above objective is as follows: an intelligent unlocking device comprises a rear shell, a front shell, a motor assembly arranged in the rear shell, and a hollow rotating shaft connected with the motor assembly and used for transmitting power, and further comprises an adapting piece having an end connected with a lock cylinder and an end connected with the hollow rotating shaft, a manual rotating shaft having an end penetrating through the hollow rotating shaft to be connected with the adapting piece and an end fixedly connected with the inner surface of the front shell, an inner bearing and a bearing support which are disposed around the manual rotating shaft, an outer bearing fixedly connected with the inner surface of the front shell, a battery pack, and a main board; the bearing support and the outer bearing are disposed around the end, fixedly connected with the inner surface of the front shell, of the manual rotating shaft; when the motor assembly drives the hollow rotating shaft to rotate, the adapting piece rotates synchronously to drive the manual rotating shaft to rotate accordingly; when the front shell is rotated, the manual rotating shaft rotates synchronously to drive the adapting piece to rotate accordingly; and the front shell does not make contact with the rear shell. The rear shell is fixed to the inner surface of a door panel, the motor assembly is fixedly arranged in the door shell, a connecting cylinder of the hollow rotating shaft is inserted into the motor assembly, two claws are arranged on the back of a connecting disc of the hollow rotating shaft and make contact with two protrusions on the outer wall of the adapting piece under certain conditions, one end of the manual rotating shaft is fixedly connected with the inner surface of the front shell, the other end of the manual rotating shaft penetrates through the connecting cylinder of the hollow rotating shaft to be inserted into one end of the adapting piece, the inner wall of the connecting cylinder does not make contact with the manual rotating shaft, three columns used for fixing the bearing support are arranged on the inner surface of the rear shell, the inner bearing and the bearing support are disposed around the manual rotating shaft, the inner bearing is fixed to the manual rotating shaft, and the other surface of the outer bearing fixedly arranged on the inner surface of the front shell makes contact with an end face of the bearing support. When a mobile terminal is used for unlocking, the motor assembly starts to drive the hollow rotating shaft to rotate, then the two claws respectively make contact with the two protrusions, the hollow rotating shaft synchronously drives the adapting piece to rotate, then the adapting piece drives the lock cylinder connected with one end of the adapting piece to rotate to unlock a door lock; and in this process, the manual rotating shaft rotates along with the adapting piece, the inner bearing and the front shell which are fixedly connected with the manual rotating shaft rotate synchronously, and the outer bearing connected with the front shell rotate relative to the bearing support. After users come indoors, the motor assembly idles by a certain angle in a direction opposite to the unlocking direction, at this moment, the claws are separated from the protrusions, the hollow rotating shaft idles accordingly, while the adapting piece remains static; and when the claws make contact with the protrusions again, the adapting piece rotates along with the hollow rotating shaft until the door lock is automatically locked. When the device is operated indoors, the front shell is rotated in a direction consistent with the unlocking direction of the motor assembly, the front shell drives the manual rotating shaft and the outer bearing to rotate, then the adapting piece connected with one end of the manual rotating shaft is driven to rotate, and then the adapting piece drives the lock cylinder to rotate to complete unlocking indoors; and in this process, the two claws make contact with the two protrusions, and the hollow rotating shaft rotates along with the adapting piece to drive the motor assembly to rotate to an unlocking position. If the door lock will not be manually locked anymore after being manually unlocked, the motor assembly rotates in reverse to automatically lock the door lock. The front shell does not make contact with the rear shell, so that friction between the front shell and the rear shell is avoided when the front shell rotates during unlocking, and accordingly, noises are avoided.

Preferably, the hollow rotating shaft comprises a connecting disc, a connecting cylinder perpendicularly arranged on one surface of the connecting disc, and two claws arranged on the other surface of the connecting disc and separably connected with one end of the adapting piece, wherein the connecting disc, the connecting cylinder and the claws are integrally formed, and two parallel vertical faces of the outer wall of the connecting cylinder are planes. A through hole coaxial with the connecting cylinder is formed in the connecting disc, and one end of the manual rotating shaft penetrates through the hollow rotating shaft via the through hole to be connected with the adapting piece.

Preferably, the adapting piece is integrally formed by two coaxial cylinders with different diameters, wherein a small-diameter cylinder is connected with the manual rotating shaft and has an end formed with an axial insertion hole, and a plane to be combined with the manual rotating shaft is arranged on the inner wall of the axial insertion hole; two protrusions separably connected with the hollow rotating shaft are arranged on the outer wall of a large-diameter cylinder; the large-diameter cylinder of the adapting piece is connected with the lock cylinder, and an axial square hole is formed in an end, connected with the lock cylinder, of the large-diameter cylinder; and the protrusions and the large-diameter cylinder are integrally formed.

Preferably, the manual rotating shaft is cylindrical, an insert and an adaptor are respectively arranged at the two ends of the manual rotating shaft, and one vertical face of the insert is a plane; a limiting part is arranged on the outer wall of the manual rotating shaft and is a convex ring; and the inner bearing is located in the bearing support. When the manual rotating shaft is connected with the adapting piece, the planar vertical face of the adaptor is attached to the plane in the axial insertion hole, so that the manual rotating shaft and the adapting piece are prevented from rotating relative to each other.

Preferably, the bearing support comprises an annular base plate and a cylindrical tube perpendicularly arranged on the base plate and coaxial with the base plate, and the annular base plate and the cylindrical tube are integrally formed.

Furthermore, three connecting pieces which are integrated with the annular base plate are arranged on the outer wall of the annular base plate and are provided with screw holes.

Three columns which are fixedly connected with the rear shell are arranged on the inner bottom surface of the rear shell and are fixedly connected with the three connecting pieces through screws respectively.

The battery pack comprises two battery cases which are fixedly arranged in the rear shell and connected with each other, and at least one battery arranged in each battery case; two windows which correspond to the battery cases and are used for taking and placing the batteries are arranged in the front shell; and the main board is fixedly arranged in the rear shell and is connected with the battery pack.

A surface cover is arranged on the surface of the front shell, and the surface cover and the front shell are each internally provided with at least one magnet and are attracted to each other through the magnets.

In order to transform the indoor side of a traditional door lock, the intelligent unlocking device further comprises a fixing plate fixedly arranged on the inner surface of the door panel and used for connecting the rear shell with the door panel, and two screw fixing brackets arranged in the fixing plate and used for connecting the door panel with the fixing plate; an adapting hole allowing the end, connected with the lock cylinder, of the adapting piece to penetrate through is arranged in the fixing plate; and two arc notches are symmetrically formed in the fixing plate.

Two sinking bases which are respectively located on two sides of the adapting hole are arranged in the fixing plate, holes are formed in the bottoms of the sinking bases, and clamping holes are formed beside the holes; each of the two screw fixing brackets comprises a sinking plate and a clamping plate arranged on the bottom surface of one end of the sinking plate and integrated with the sinking plate; screw holes are formed in the sinking plates; and the sinking plates are attached to the bottom surfaces of the sinking bases, the holes are aligned to the screw holes, and the clamping plates are inlaid in the clamping holes. Screws on the traditional lock installed on the door panel penetrate through the sinking plates and the sinking bases to fix the fixing plate on the door panel.

To facilitate quick assembly and disassembly, two identical connecting assemblies are arranged on the back of the rear shell. Each connecting assembly comprises a rotatable member, a fastening screw used for fixing the rotatable member and serving as a rotation axis, and a tower spring disposed around the fastening screw and having a large-diameter end face in contact with the rotatable member, wherein the rotatable member is integrally formed by a body with an arc side face, and an arc plate. The bodies of the two rotatable members are movably inlaid in the two arc notches of the fixing plate and rotate in the arc notches by a certain angle with the fastening screws as the rotation axes.

In order to make the whole device light and thin, the motor assembly is preferably a JL-12TN20 motor.

The invention has the following beneficial effects: no matter whether unlocking is realized through driving of the motor assembly or through indoor rotation of the front shell, it is the inner bearing and the outer bearing that rotate, and the front shell does not make contact with the rear shell, so that friction is avoided in the unlocking process, and noises will not be generated between the front shell and the rear shell; the fixing plate is fixed to the inner surface of the door panel and is separably connected with the rear shell through the two rotatable members, and one end of the adapting piece is connected with the lock cylinder of the traditional lock, so that the intelligent unlocking device can be conveniently assembled and disassembled when used to transform the indoor side of the traditional lock. Compared with the prior art, the intelligent unlocking device is silent and free of noises in use, good in user experience, and convenient to assemble and disassemble, so that intelligent unlocking can be achieved by transformation of the indoor side of the traditional door lock without replacing the whole door lock, and costs are reduced for users.

DETAILED DESCRIPTION OF THE INVENTION

Figure 1:
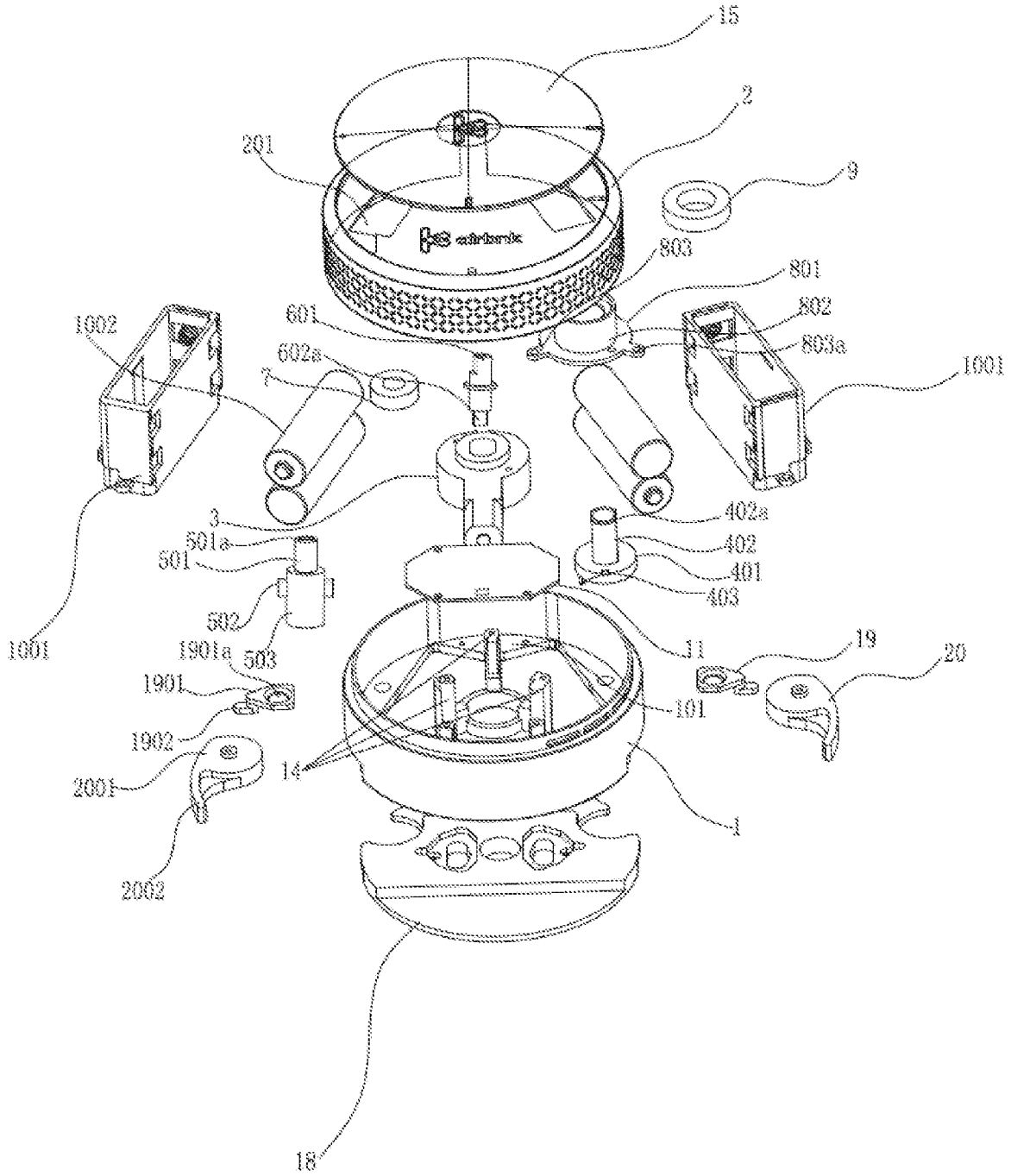
FIG. 1 is an exploded view of the invention.
Figure 2:
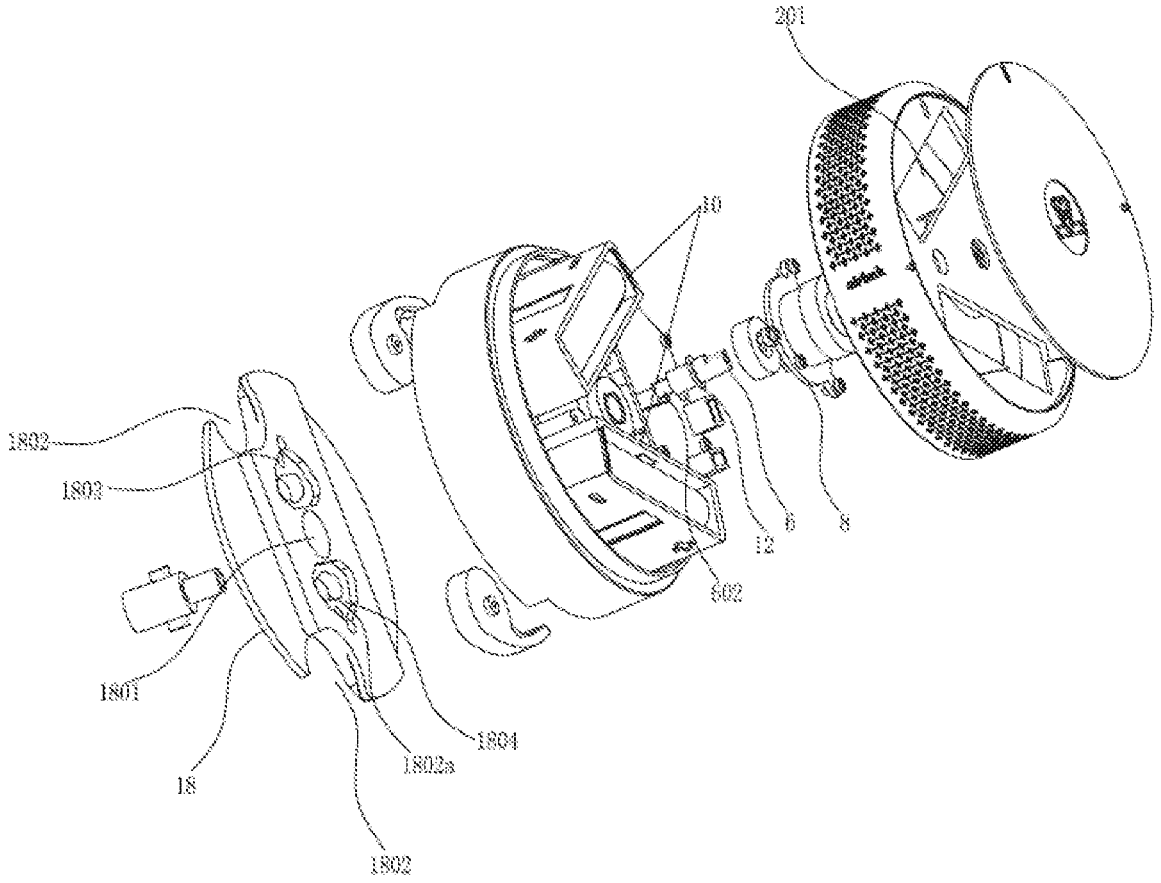
FIG. 2 is another exploded view of the invention.
Figure 3:
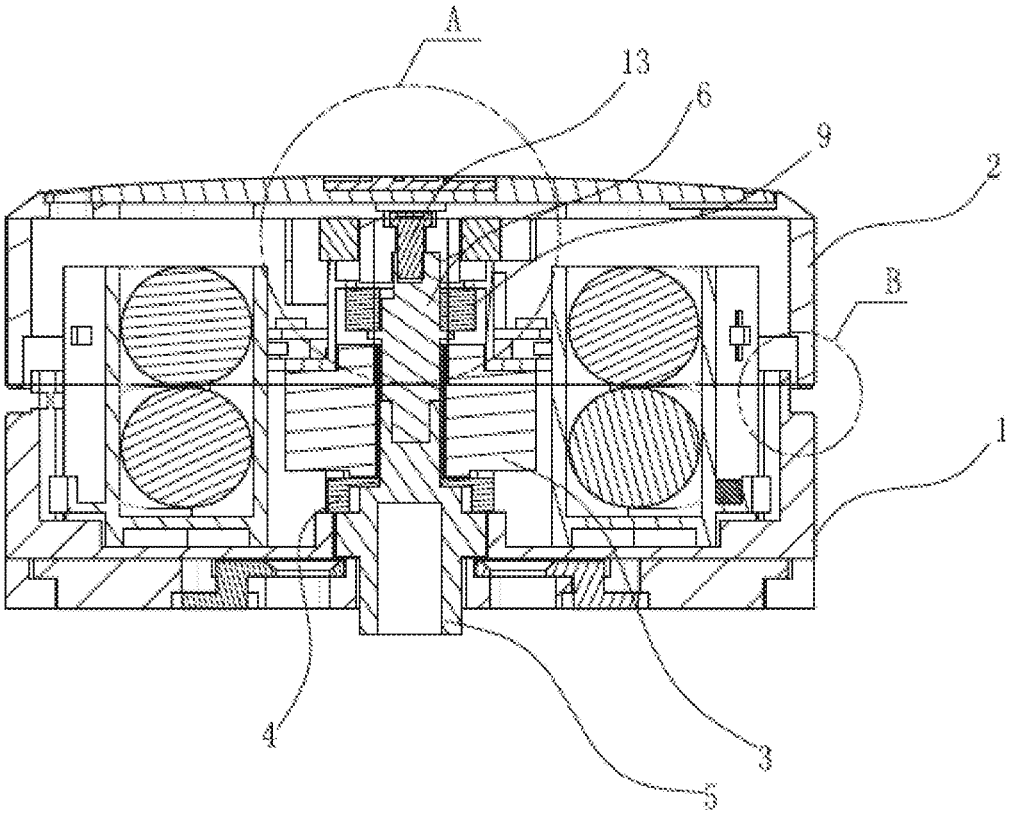
FIG. 3 is a sectional view of the invention.
Figure 4:
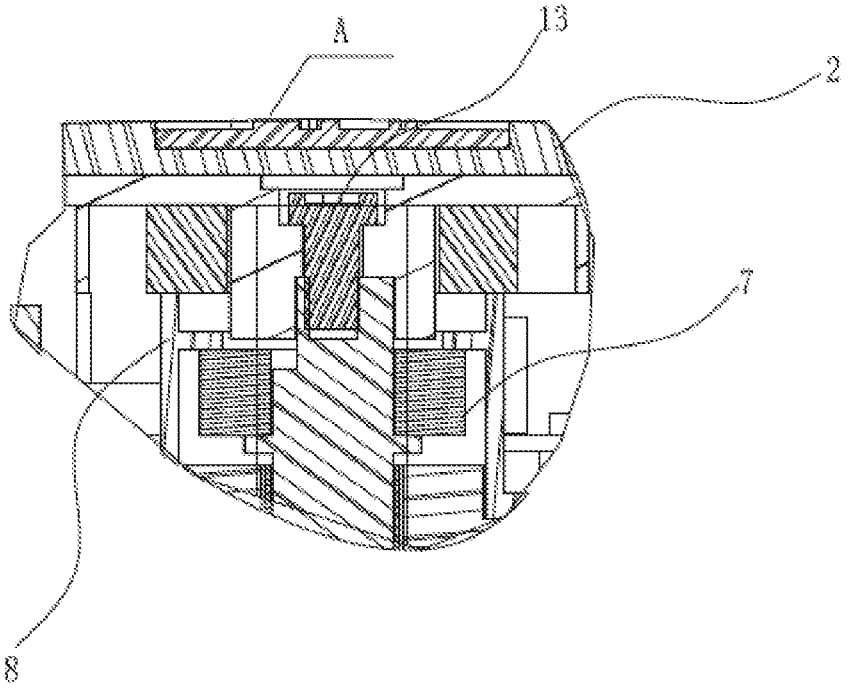
FIG. 4 is an enlarged view of part A in FIG. 3.
Figure 5:
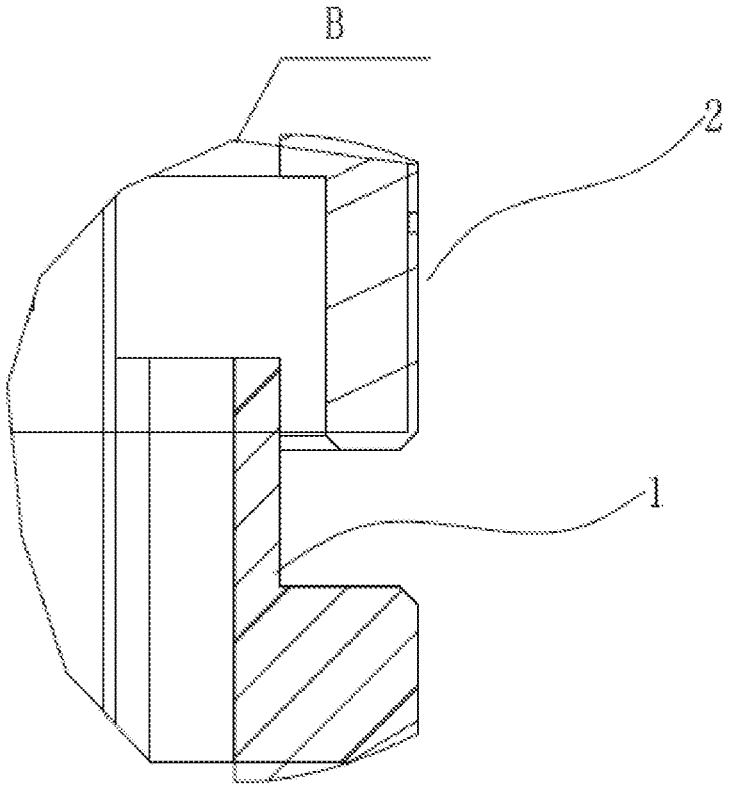
FIG. 5 is an enlarged view of part B in FIG. 3.

The invention is further expounded below with reference to the accompanying drawings and embodiments, so that those skilled in the art can have a better understanding of the technical solutions of the invention.

As shown in FIG. 1-FIG. 5 and FIG. 10, an intelligent unlocking device comprises a rear shell 1, a front shell 2, a motor assembly 3 arranged in the rear shell, and a hollow rotating shaft 4 connected with the motor assembly and used for transmitting power, and further comprises an adapting piece 5 having an end connected with a lock cylinder and an end connected with the hollow rotating shaft 4, a manual rotating shaft 6 having an end penetrating through the hollow rotating shaft 4 to be connected with the adapting piece 5 and an end fixedly connected with the inner surface of the front shell, an inner bearing 7 and a bearing support 8 which are disposed around the manual rotating shaft 6, an outer bearing 9 fixedly connected with the inner surface of the front shell, a battery pack 10, and a main board 11. The outer bearing 9 is in contact with an end face of the bearing support 8.

In this embodiment, in order to reduce the thickness of the whole device, the motor assembly 3 is preferably a commercially-available JL-12TN20 motor and is flat on the whole. Clearly, other commercially-available products having similar characteristics can also be adopted to fulfill the same effect.

In this embodiment, the structures of the corresponding components are as follows:

The hollow rotating shaft 4 comprises a connecting disc 401, a connecting cylinder 402 perpendicularly arranged on one surface of the connecting disc, and two claws 403 arranged on the other surface of the connecting disc and separably connected with one end of the adapting piece, wherein the connecting disc 401, the connecting cylinder 402 and the claws 403 are integrally formed; and two parallel vertical faces 402*a* of the outer wall of the connecting cylinder are planes, so that the connecting cylinder can be inserted into a center hole of the motor assembly 3 and will not rotate relative to the motor assembly. A through hole coaxial with the connecting cylinder is formed in the connecting disc, and one end of the manual rotating shaft 6 penetrates through the hollow rotating shaft 4 via the through hole to be connected with the adapting piece 5.

The adapting piece 5 is integrally formed by two coaxial cylinders with different diameters, wherein a small-diameter cylinder 501 is connected with the manual rotating shaft 6 and has an end formed with an axial insertion hole 501*a*, and a plane to be combined with the manual rotating shaft is formed on the inner wall of the axial insertion hole 501*a*; two protrusions 502 to be separably connected with the hollow rotating shaft are arranged on the outer wall of a large-diameter cylinder 503; the large-diameter cylinder 503 of the adapting piece is connected with the lock cylinder, and an axial square hole 504 is formed in an end, connected with the lock cylinder, of the large-diameter cylinder; and the protrusions 502 and the large-diameter cylinder 503 are integrally formed.

The manual rotating shaft 6 is cylindrical, an insert 601 and an adaptor 602 are respectively arranged at the two ends of the manual rotating shaft, and one vertical face 602*a* of the adaptor 602 is a plane; a limiting part 12 fixedly connected with the manual rotating shaft is arranged on the outer wall of the manual rotating shaft and is a convex ring; and the inner bearing 7 is located in the bearing support 8. When the manual rotating shaft 6 is connected with the adapting piece 5, the planar vertical face 602*a* of the adaptor 602 is attached to the plane in the axial insertion hole 501*a*, so that the manual rotating shaft 6 and the adapting piece 5 are prevented from rotating relative to each other after being connected. The manual rotating shaft 6 is fixedly connected with the front shell 2 through a bolt 13. The insert 601, the adaptor 602 and the manual rotating shaft 6 are integrally formed.

Figure 11:
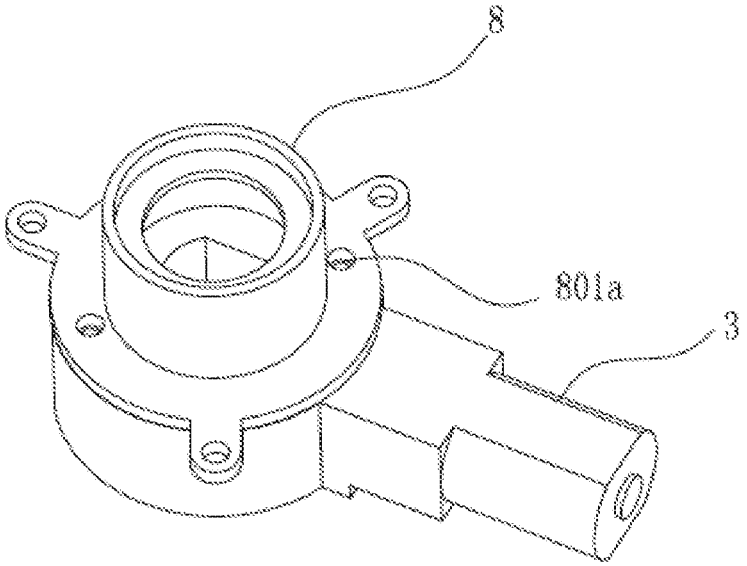
FIG. 11 is an installation diagram of a motor assembly of the invention.

The bearing support 8 comprises an annular base plate 801 and a cylindrical tube 802 perpendicularly arranged on the base plate and coaxial with the base plate, wherein the annular base plate and the cylindrical tube are integrally formed. As shown in FIG. 11, the annular base plate 801 is provided with at least two motor mounting holes 801*a* used for mounting and locking the motor assembly 3 on the bearing support 8, and the motor assembly is fixed to the bearing support 8 with screws.

The bearing support is fixed through three connecting pieces 803 arranged on the outer wall of the annular base plate and integrated with the annular base plate, and the connecting pieces are provided with screw holes 803*a*.

Three columns 14 fixedly connected with the rear shell are arranged on the inner bottom surface of the rear shell and are fixedly connected with the three connecting pieces 803 through screws respectively.

The cylindrical tube 802 of the bearing support and the outer bearing 9 are disposed around the end, fixedly connected with the inner surface of the front shell 2, of the manual rotating shaft 6.

The battery pack 10 comprises two battery cases 1001 fixedly arranged in the rear shell and connected with each other, and at least one battery 1002 arranged in each battery case, and the number of the batteries can be determined according to the design requirements; two windows 201 corresponding to the battery cases and used for taking and placing the batteries are arranged in the front shell 2; and the main board 11 is fixedly arranged in a connecting area 101 in the rear shell and is connected with the battery pack 10 and the motor assembly 3.

Figure 8:
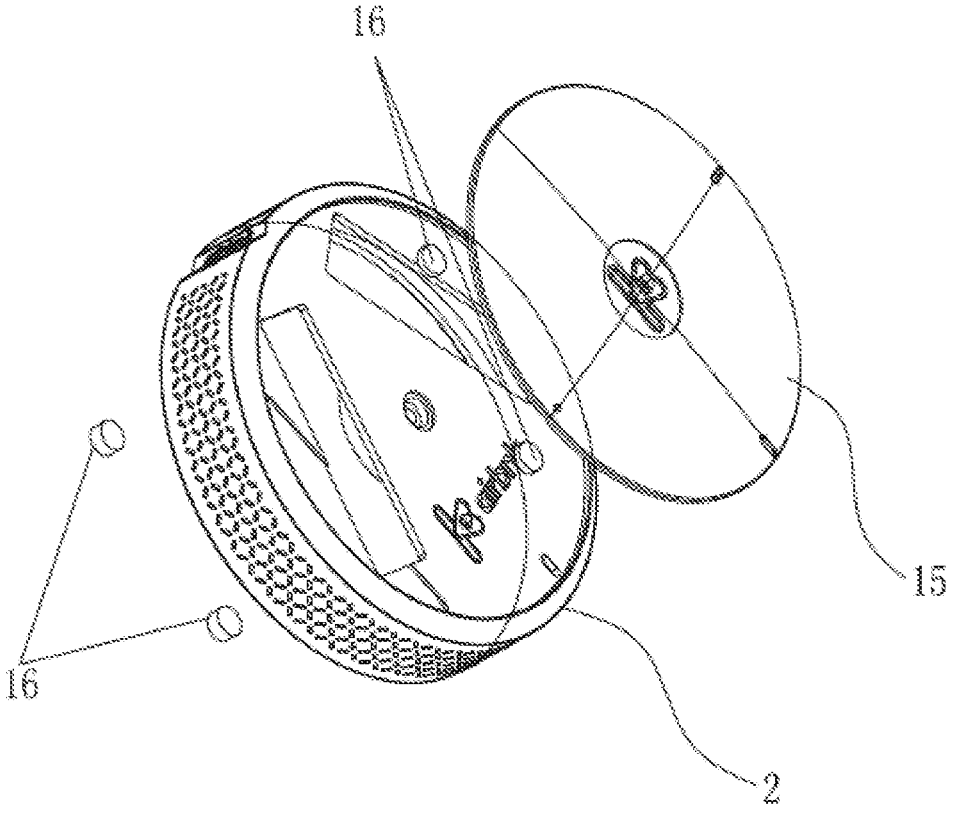
FIG. 8 is an exploded view of a front shell and a surface cover of the invention.

As shown in FIG. 8, a surface cover 15 is arranged on the surface of the front shell, and the surface cover and the front shell are each internally provided with at least one magnet 16 and are attracted to each other through the magnets 16. In this embodiment, two magnets 16 are fixedly arranged in the surface cover 15, and two magnets 16 to be attached to the two magnets in the surface cover are fixedly arranged in the front shell 2; and the surface cover 15 used for decoration and for shielding the two windows 201 in the front shell 2 needs to be disassembled sometimes, and the surface cover and the front shell are locked by magnet attraction instead of screws in the prior art, so that the structure is simple, using is convenient, and the whole device is regular and attractive in appearance.

Figure 6:
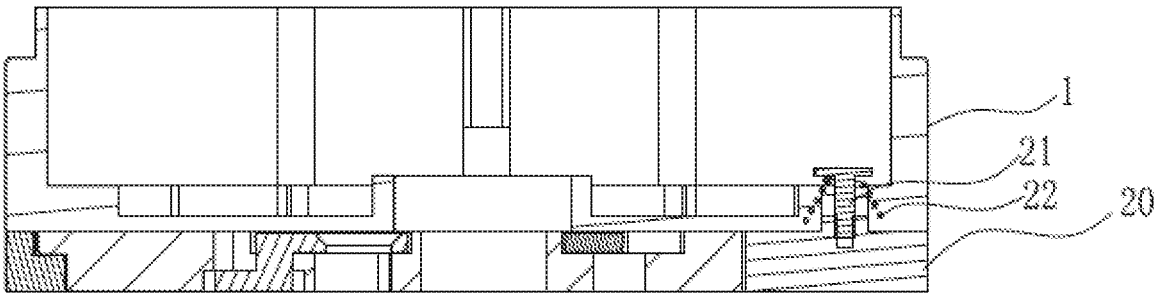
FIG. 6 is a sectional view of a connecting assembly and a rear shell connected with the connecting assembly of the invention.
Figure 7:
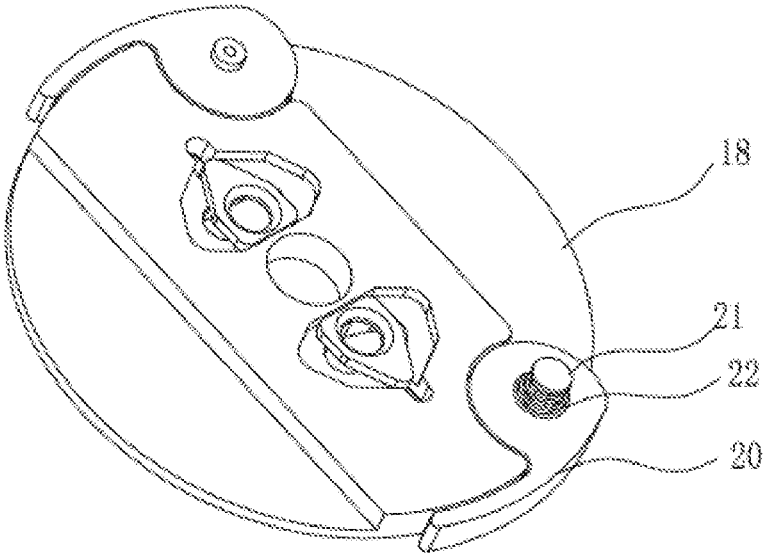
FIG. 7 is a perspective view of a rotatable member and a fixing plate connected with the rotatable member of the invention.

As shown in FIG. 6-FIG. 7, in this embodiment, in order to transform the indoor side of a traditional door lock, the intelligent unlocking device further comprises a fixing plate 18 fixedly arranged on the inner surface of a door panel and used for connecting the rear shell 1 with the door panel, and two screw fixing brackets 19 arranged in the fixing plate and used for connecting the door panel with the fixing plate, wherein an adapting hole 1801 allowing the end, connected with the lock cylinder, of the adapting piece 5 to penetrate through is formed in the fixing plate 18, and two arc notches 1802 are symmetrically formed in the fixing plate.

In order to fasten the fixing plate 18 on the door panel, two sinking bases 1804 which are respectively located on two sides of the adapting hole 1801 are arranged in the fixing plate, holes 1802*a* are formed in the bottoms of the sinking bases, and clamping holes 1803 are formed beside the holes; each of the two screw fixing brackets 19 comprises a sinking plate 1901 and a clamping plate 1902 arranged on the bottom surface of one end of the sinking plate 1901 and integrated with the sinking plate; and screw holes 1901*a* are formed in the sinking plates; and the sinking plates are attached to the bottom surfaces of the sinking bases, the holes 1802*a* are aligned to the screw holes, and the clamping plates 1902 are inlaid in the clamping holes 1803. Screws on the traditional door lock mounted on the door panel penetrate through the sinking plates 1901 and the sinking bases 1804 to fasten the fixing plate 18 on the door panel.

In order to facilitate quick assembly and disassembly of the rear shell 1, two identical connecting assemblies are arranged on the back of the rear shell. Each connecting assembly comprises a rotatable member 20, a fastening screw 21 used for fixing the rotatable member and serving as a rotation axis, and a tower spring 22 disposed around the fastening screw and having a large-diameter end face in contact with the rotatable member, wherein the rotatable member 20 is integrally formed by a body 2001 having an arc side face, and an arc plate 2002. The bodies 2001 of the two rotatable members are movably inlaid in the two arc notches 1802 of the fixing plate and are able to rotate in the arc notches by a certain angle with the fastening screws 21 as the rotation axes. When the rear shell 1 needs to be disassembled from the fixing plate, namely when the whole intelligent unlocking device needs to be disassembled, the arc plates 2002 are pulled to drive the bodies 2001 to rotate by a certain angle to be disengaged from the arc notches 1802, and then the rear shell can be removed; when the rear 1 needs to be assembled on the fixing plate 18, the two bodies 2001 are respectively inlaid into the two arc notches 1802, and then the arc plates 2002 are pulled to drive the bodies 2001 to rotate in place to attach the arc plates 2002 to the side faces of the fixing plate, so that assembly of the whole device is completed; and after the device is assembled, an iron sheet connected with the lock cylinder is inserted into the axial square hole 504. The tower springs 22 are located between nuts of the fastening screws and the rotatable members and are in a compressed state, so that the rotatable members can be prevented from getting loose in long-term use.

Figure 9:
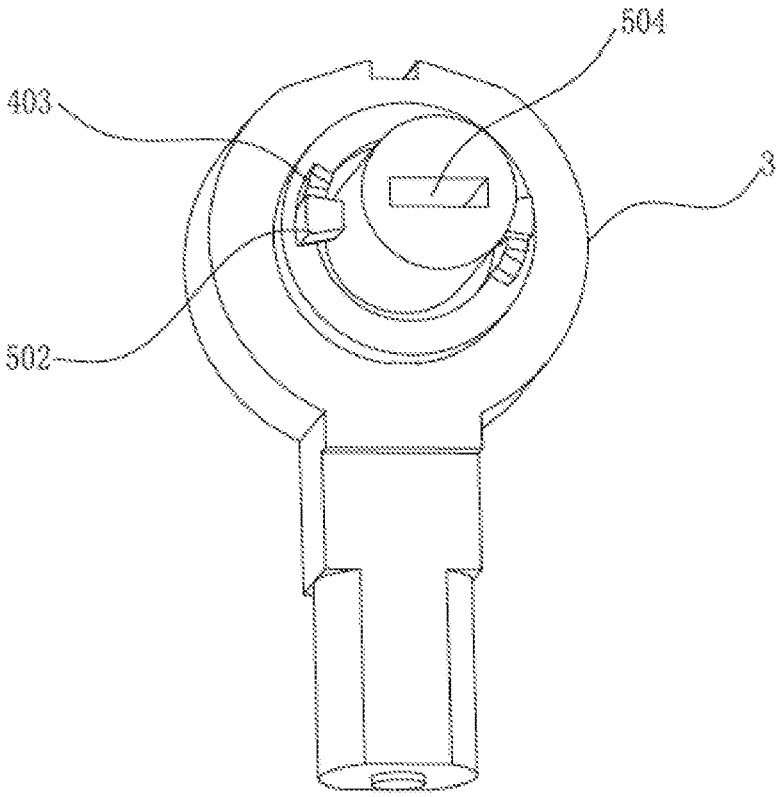
FIG. 9 is a combination diagram of a hollow rotating shaft and an adapting piece of the invention.
Figure 10:
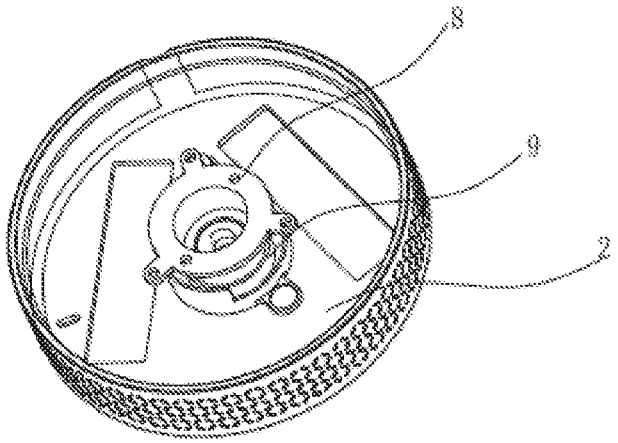
FIG. 10 is a partial perspective view of the invention.

From the above description, the rear shell 1 is fixed to the inner surface of the door panel through the fixing plate 18, the motor assembly 3 is fixedly arranged in the rear shell 1, the connecting cylinder 402 of the hollow rotating shaft 4 is inserted into the motor assembly 3, the two claws 403 arranged on the back of the connecting disc 401 of the hollow rotating shaft make contact with the two protrusions 502 on the outer wall of the adapting piece under certain conditions, one end of the manual rotating shaft 6 is fixedly connected with the inner surface of the front shell, the other end of the manual rotating shaft 6 penetrates through the connecting cylinder 402 of the hollow rotating shaft 4 to be inserted into one end of the adapting piece 5, the inner wall of the connecting cylinder 402 is not in contact with the manual rotating shaft 6, the three columns 14 used for fixing the bearing support are arranged on the inner surface of the rear shell, the inner bearing 7 and the bearing support 8 are disposed around the manual rotating shaft 6, the inner bearing 7 is fixed to the manual rotating shaft 6, and the other surface of the outer bearing fixedly arranged on the inner surface of the front shell makes contact with one end face of the bearing support 8. When a mobile terminal is used for unlocking, the mobile terminal sends out an instruction, then the motor assembly 3 connected with the main board 11 starts to drive the hollow rotating shaft 4 to rotate, the two claws 403 make contact with the two protrusions 502, as shown in FIG. 9, the hollow rotating shaft 4 synchronously drives the adapting piece 5 to rotate, and then the adapting piece 5 drives the lock cylinder connected with one end of the adapting piece to rotate to unlock the door lock; and in this process, the manual rotating shaft 6 rotates along with the adapting piece 5, the inner bearing 7 and the front shell 2 which are fixedly connected with the manual rotating shaft 6 rotate synchronously, and the outer bearing 9 connected with the front shell rotates in the bearing support 8; When the device is operated indoors, the front shell 2 is rotated in a direction consistent with the unlocking direction of the motor assembly 3, the front shell 2 drives the manual rotating shaft 6 and the outer bearing 9 to rotate, then the adapting piece 5 connected with one end of the manual rotating shaft is driven to rotate, and then the adapting piece 5 drives the lock cylinder to rotate, so that unlocking is completed indoors; and in this process, the two claws 403 respectively make contact with the two protrusions 502, and the hollow rotating shaft 4 rotates along the adapting piece 5 to drive the motor assembly 3 to rotate to an unlocking position. If the door will not be manually locked anymore after being manually unlocked, the motor assembly 3 rotates in reverse to automatically lock the door lock. The front shell 2 does not make contact with the rear shell 1, so that friction between the front shell 2 and the rear shell 1 is avoided when the front shell 2 rotates in the unlocking process, and accordingly, noises are avoided. Generally, when different traditional locks are unlocked outdoors or indoors, the rotation direction of the lock cylinder is constant, so that the rotation direction of the front shell 2 is certain during unlocking, and the front shell cannot be rotated in an opposite direction.

The unlocking principle of the motor assembly 3 is as follows: the door lock is generally in an unlocked state or in a locked state; when the door lock is to be unlocked, the motor assembly 3 rotates to drive the hollow rotating shaft 4 to rotate, at this moment, the two claws 403 respectively make contact with the two protrusions 502, and thus, the adapting piece rotates accordingly to drive the lock cylinder to rotate to realize unlocking; and when the door lock is to be locked, the motor assembly 3 rotates by a certain distance in a direction opposite to the rotating direction in the previous process and then idles for a while, at this moment, the hollow rotating shaft 4 rotates synchronously, and the two claws 403 are separated from the two protrusions 502; after the hollow rotating shaft 4 rotates by a certain angle, the two claws 403 make contact with the two protrusions 502 again, the adapting piece 5 rotates accordingly to drive the lock cylinder to rotate in a direction opposite to the direction in the previous process, and finally, the lock cylinder is driven to return to the original position.

No matter whether unlocking is realized through driving of the motor assembly 3 or through indoor rotation of the front shell 2, it is the inner bearing 7 and the outer bearing 9 that rotate, and the front shell 2 does not make contact with the rear shell 1, so that friction is avoided in the unlocking process, and noises will not be generated between the front shell 2 and the rear shell 1; the fixing plate 18 is fixed to the inner surface of the door panel and is separably connected with the rear shell 1 through the two rotatable members 20, and one end of the adapting piece 5 is connected with the lock cylinder of the traditional lock, so that the intelligent unlocking device can be conveniently assembled and disassembled when used to transform the indoor side of the traditional lock. Compared with the prior art, the intelligent unlocking device is silent and free of noises in use, good in user experience, and convenient to assemble and disassemble, so that intelligent unlocking can be achieved by transformation of the indoor side of the traditional door lock without replacing the whole door lock, and costs are reduced for users.

Although the invention is described above in combination with the embodiments, those ordinarily skilled in the art would appreciate that various modifications and alterations of the invention can be obtained without deviating from the spirit of the invention, and all these modifications and alterations should also fall within the scope of the appended claims.

What is claimed is:

1. An intelligent unlocking device, comprising a rear shell, a front shell, a motor assembly arranged in the rear shell, and a hollow rotating shaft connected with the motor assembly and used for transmitting power, wherein the intelligent unlocking device further comprises an adapting piece having an end connected with a lock cylinder and an end connected with the hollow rotating shaft, a manual rotating shaft having an end penetrating through the hollow rotating shaft to be connected with the adapting piece and an end fixedly connected with the an inner surface of the front shell, an inner bearing and a bearing support which are disposed around the manual rotating shaft, an outer bearing fixedly connected with the inner surface of the front shell, a battery pack, and a main board; the outer bearing is disposed around the end, fixedly connected with the inner surface of the front shell, of the manual rotating shaft; when the motor assembly drives the hollow rotating shaft to rotate, the adapting piece rotates synchronously to drive the manual rotating shaft to rotate accordingly; when the front shell is rotated, the manual rotating shaft rotates synchronously to drive the adapting piece to rotate accordingly; and the front shell does not make contact with the rear shell.

2. The intelligent unlocking device according to claim 1, wherein the hollow rotating shaft comprises a connecting disc, a connecting cylinder perpendicularly arranged on a surface of the connecting disc, and two claws arranged on a surface of the connecting disc and separably connected with one end of the adapting piece; the connecting disc, the connecting cylinder and the claws are integrally formed; and two parallel vertical faces of an outer wall of the connecting cylinder are planes.

3. The intelligent unlocking device according to claim 1, wherein the adapting piece is integrally formed by two coaxial cylinders with different diameters; a small-diameter cylinder is connected with the manual rotating shaft and has an end formed with an axial insertion hole, and a plane to be combined with the manual rotating shaft is arranged on an inner wall of the axial insertion hole; two protrusions to be separably connected with the hollow rotating shaft are arranged on an outer wall of a large-diameter cylinder; the large-diameter cylinder of the adapting piece is connected with the lock cylinder, and an axial square hole is formed in an end, connected with the lock cylinder, of the large-diameter cylinder; and the protrusions and the large-diameter cylinder are integrally formed.

4. The intelligent unlocking device according to claim 1, wherein the manual rotating shaft is cylindrical, an insert and an adaptor are respectively arranged at the two ends of the manual rotating shaft, and one vertical face of the insert is a plane; a limiting part is arranged on an outer wall of the manual rotating shaft and is a convex ring; and the inner bearing is located in the bearing support.

5. The intelligent unlocking device according to claim 1, wherein the bearing support comprises an annular base plate and a cylindrical tube perpendicularly arranged on the base plate and coaxial with the base plate, and the annular base plate and the cylindrical tube are integrally formed.

6. The intelligent unlocking device according to claim 5, wherein three connecting pieces which are integrated with the annular base plate are arranged on an outer wall of the annular base plate and are provided with screw holes.

7. The intelligent unlocking device according to claim 6, wherein three columns fixedly connected with the rear shell are arranged on an inner bottom surface of the rear shell and are fixedly connected with the three connecting pieces through screws respectively.

8. The intelligent unlocking device according to claim 1, wherein the battery pack comprises two battery cases fixedly arranged in the rear shell and connected with each other, and at least one battery arranged on each said battery case; windows which correspond to the battery cases and are used for taking and placing the batteries are arranged in the front shell; and the main board is fixedly arranged in the rear shell and is connected with the battery pack.

9. The intelligent unlocking device according to claim 8, wherein a surface cover is arranged on a surface of the front shell, and the surface cover and the front shell are each internally provided with at least one magnet and are attracted to each other through the magnets.

10. The intelligent unlocking device according to claim 1, wherein the intelligent unlocking device further comprises a fixing plate fixedly arranged on an inner surface of a door panel and used for connecting the rear shell with the door panel, and two screw fixing brackets arranged in the fixing plate and used for connecting the door panel with the fixing plate; an adapting hole allowing the end, connected with the lock cylinder, of the adapting piece to penetrate through is formed in the fixing plate; and two arc notches are symmetrically formed in the fixing plate.

11. The intelligent unlocking device according to claim 10, wherein two sinking bases which are respectively located on two sides of the adapting hole are arranged in the fixing plate, holes are formed in bottoms of the sinking bases, and clamping holes are formed beside the holes; each of the two screw fixing brackets comprises a sinking plate and a clamping plate arranged on a bottom surface of one end of the sinking plate and integrated with the sinking plate; and screw holes are formed in the sinking plates; the sinking plates are attached to bottom surfaces of the sinking bases, the through holes are aligned to the screw holes, and the clamping plates are inlaid in the clamping holes.

12. The intelligent unlocking device according to claim 1, wherein two identical connecting assemblies are arranged on a back of the rear shell; each said connecting assembly comprises a rotatable member, a fastening screw used for fixing the rotatable member and serving as a rotation axis, and a tower spring disposed around the fastening screw and has a large-diameter end face in contact with the rotatable member; and each said rotatable member is integrally formed by a body having an arc side face, and an arc plate.

13. The intelligent unlocking device according to claim 1, wherein the motor assembly is a JL-12TN20 motor.

* * * * *